US005118312A

United States Patent [19]

Lu

[11] Patent Number: 5,118,312

[45] Date of Patent: Jun. 2, 1992

[54] INVERTIBLE ADAPTER SOCKET STRUCTURE

[75] Inventor: Juinn-Horng Lu, Yun Lin, Taiwan

[73] Assignee: Pan-International Industrial Corp., Taipei, Taiwan

[21] Appl. No.: 713,271

[22] Filed: Jun. 11, 1991

[51] Int. Cl.[5] ..... H01R 23/02

[52] U.S. Cl. ..... 439/676; 439/218

[58] Field of Search ..... 439/217-222, 439/676, 344, 660

[56] References Cited

U.S. PATENT DOCUMENTS

| | | | |
|---|---|---|---|
| 3,441,896 | 4/1969 | Hawkins | 439/222 |
| 4,047,781 | 9/1977 | DeNigris et al. | 439/218 |
| 4,371,227 | 2/1983 | Yosimura | 439/676 |
| 4,679,879 | 7/1987 | Triner et al. | 439/676 |
| 4,946,401 | 8/1990 | Hori et al. | 439/217 |

*Primary Examiner*—David L. Pirlot

*Attorney, Agent, or Firm*—Fleit, Jacobson, Cohn, Price, Holman & Stern

[57] ABSTRACT

For use in a communication network, an adapter socket structure comprising a molded receptacle which has a plug hole longitudinally disposed at one end, a through-hole vertically through said plug hole at the middle and two rows of terminal slots at an opposite end on the top and bottom edges thereof; a movable jack plate movably set in said through-hole, which has an opening longitudinally aligned with said plug hole and two rows of terminal slots on the top and bottom edges thereof; and two sets of terminals respectively fastened in the rows of terminal slots on said molded receptacle and said movable jack plate, which have each a curved contact end disposed in position opposed to each other; and wherein said movable jack plate is moved downwards or upwards in said through-hole by means of the spring force from either set of terminals for connecting a plug which is inserted therein either in a normal or inverted position.

2 Claims, 3 Drawing Sheets

INVERTIBLE ADAPTER SOCKET STRUCTURE

BACKGROUND OF THE INVENTION

The present invention relates to an adapter socket structure and relates more particularly to an invertible adapter socket structure for use in a communication network into which a plug can be inserted either in a normal or inverted position.

FIGS. 1 and 2 illustrate an adapter socket structure according to the prior art which is generally comprised of a molding receptacle 11 having a set of terminals 13 on the bottom edge in the plug hole 12 thereof. During assembly, the set of terminals 13 is inserted from a hole 15 on the bottom edge of the molding receptacle 11 and then set into place with the terminal contact end thereof resiliently disposed in an oblique position for connecting the terminals from a plug 14. During connection, a plug 14 must be properly inserted in the plug hole in a normal position. One disadvantage of this adapter socket structure is that the set of terminals in the molding receptacle may be displaced from position causing contact error. Another disadvantage of this adapter socket structure is that the adapter socket required a set of terminals in longer length which increases material cost. Still another disadvantage of this adapter socket structure is that a plug must be inserted in the plug hole in a normal position. If a plug is inserted in the plug hole in an inverted position, it will cause contact failure problem.

SUMMARY OF THE INVENTION

The present invention has been accomplished to eliminate the aforesaid problems. It is therefore an object of the present invention to provide an adapter socket structure for use in a communication network which permits a plug to insert therein either in a normal or inverted position without affecting its performance.

It is another object of the present invention to provide an adapter socket structure which has two sets of terminals fastened therein for different functions.

It is another object of the present invention to provide an adapter socket structure which has means to firmly retain the terminals therein in place for good electric connecting performance.

DETAILED DESCRIPTION OF THE PREFERRED EMBODIMENT

Figure 3:
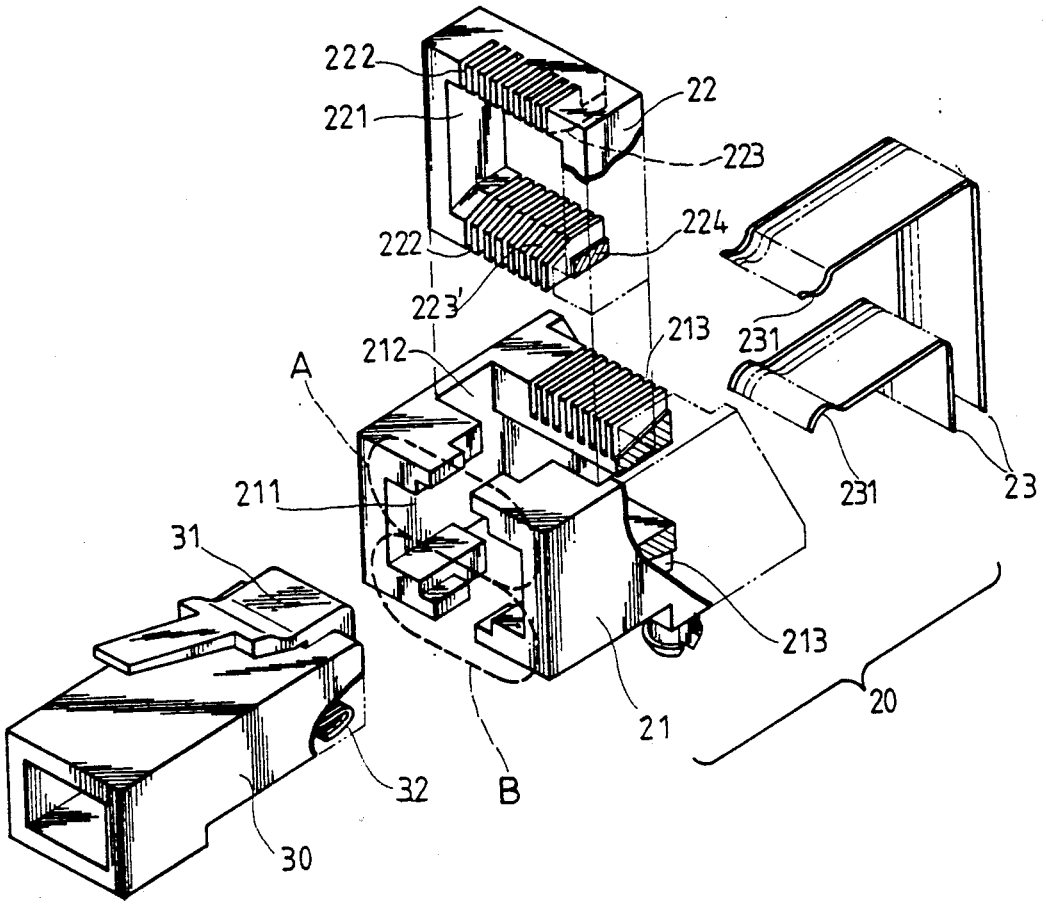
FIG. 3 is a dismantled perspective view of the preferred embodiment of the present invention.

Referring to FIG. 3, a double-way adapter socket in accordance with the present invention is generally comprised of a molded receptacle 21, a movable jack plate 22 and two sets of terminals 23.

The molded receptacle 21 is made in shape according to the purpose required, having a plug hole 211 at one end disposed in longitudinal direction, a through-hole 212 at the middle disposed in a vertical direction relative to said plug hole 211 for holding the movable jack plate 22, and two rows of terminal slots 213 at an opposite end respectively formed in the top and bottom edges thereof, wherein said plug hole 211 is formed of two symmetrical portions, namely, portion A at an upper position and portion B at a lower position, so that a plug 30 can be inserted therein either in a normal or inverted position. The movable jack plate 22 is fastened in the through-hole 212 inside the molding receptacle 21, defining therein an opening 221 longitudinally aligned with the plug hole 211, and having two rows of terminal slots 222 respectively made on the top and bottom edges thereof. The two sets of terminals 23 may be respectively provided for different functions, which are respectively formed in a substantially L-shaped structure and fastened in the rows of terminal slots 213 and 222 on the molded receptacle 21 and the movable jack plate 22. Each set of terminals 23 is terminating into a curved contact end 231.

Figure 4:
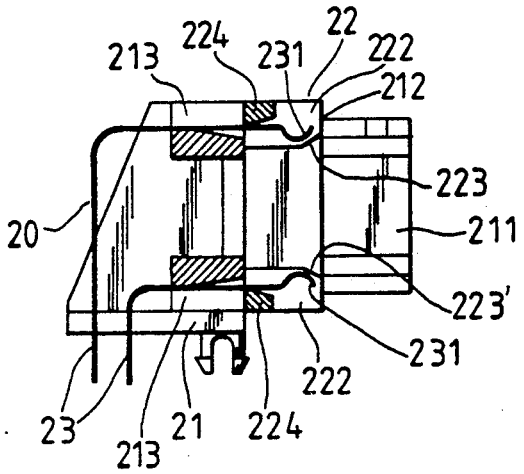
FIG. 4 is a sectional assembly view of the preferred embodiment of the present invention.

Referring to FIG. 4, the two sets of terminals 23 are respectively fastened in the rows of terminal slots 213 and 222 on the molding receptacle 21 and the movable jack plate 22 with the contact end 231 disposed in position opposed to each other, permitting the movable jack plate 22 to be moved downwards or upwards in the through-hole 212 by means of the spring force from either set of terminals 23.

Figure 5:
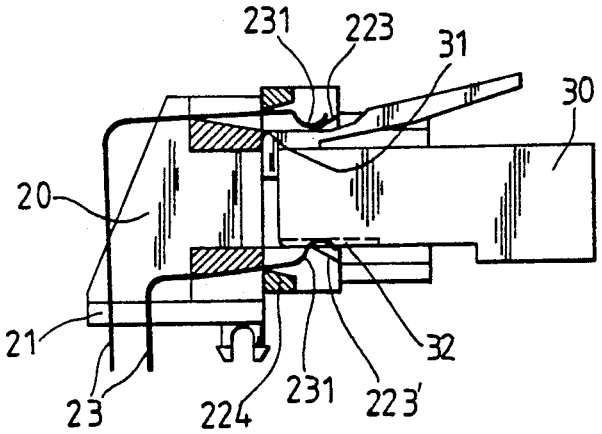
FIG. 5 illustrates that a plug is fastened in the adapter socket of the present invention in a normal position.
Figure 6:
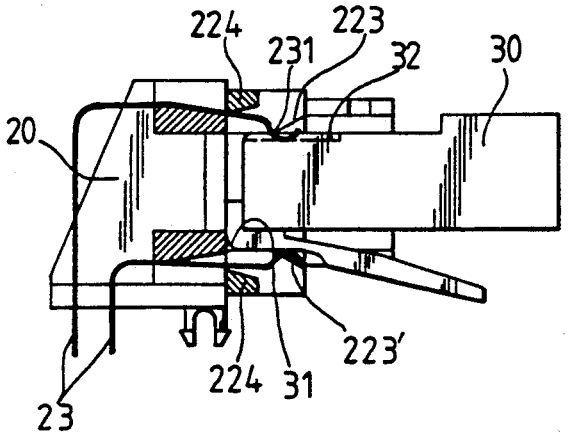
FIG. 6 illustrates the plug is fastened in the adapter socket of the present invention in an inverted position.

Referring to FIGS. 5 and 6, a plug may be inserted in the plug hole 211 either in a normal or inverted position. When a plug 30 is inserted in the plug hole 211, the front retaining projection 31 of the plug 30 pushes the front bevel edge 223 (or 223' when it is inserted in an inverted position) of the movable jack plate 22, causing the movable jack plate 22 to displace upwards (or downwards), and therefore, the curved contact end 231 of the set of terminals 23, namely, the lower set of terminals which is disposed farther from the front retaining projection 31 is pushed upwards, by the projecting end 224 on the movable jack plate 22, to become tightly in contact with the terminals 32 on the bottom edge of the plug 30.

Figure 1:
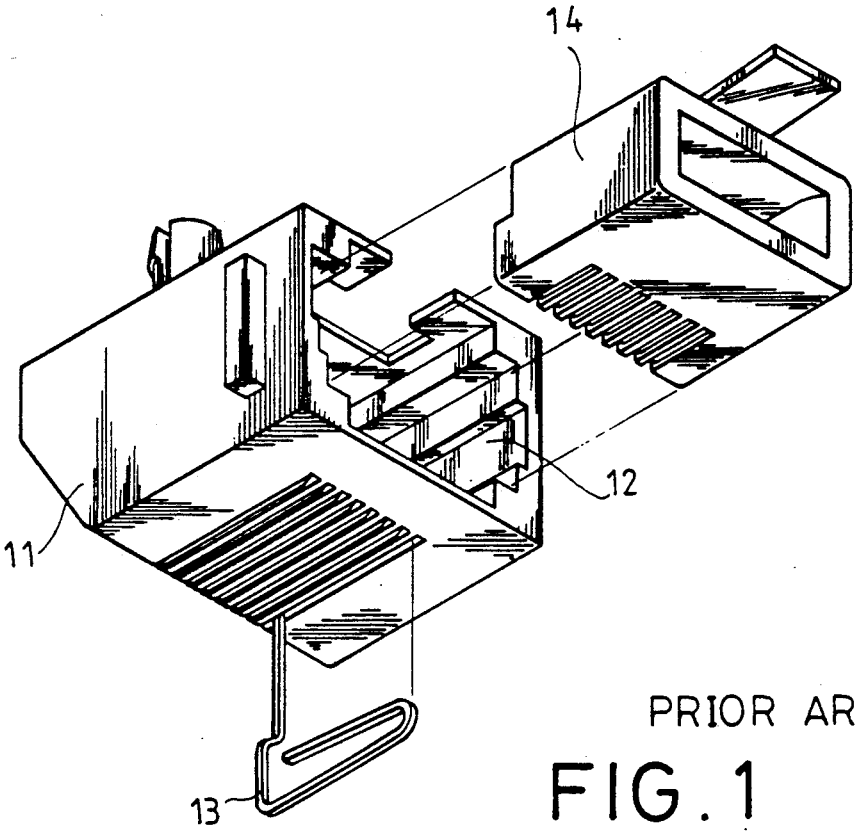
PRIOR ART FIG. 1
FIG. 1 is a perspective view of an adapter socket according to the prior art.
Figure 2:
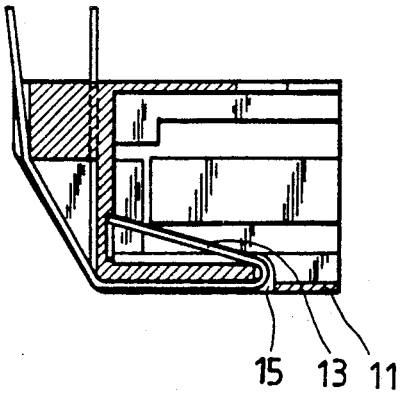
PRIOR ART FIG. 2
FIG. 2 is a sectional view of the adapter socket according to the prior art.

According to the aforesaid structure, each set of terminals 23 can be made in shorter length (in comparison with the prior art as shown in FIG. 2) to reduce material consumption and electroplating expense. Because the sets of terminals 23 can be made in shorter length, they can be directly conveniently fastened in the terminal slots 213 and 222 of the molded receptacle 21 and the movable jack plate 22.

What is claimed is:

1. For use in a communication network, an adapter socket structure comprising:

a molded receptacle, having a plug hole at one end disposed in longitudinal direction and made vertically symmetrical, a through-hole at a middle region disposed in a vertical direction relative to said plug hole, and two rows of terminal slots at an opposite end respectively formed in top and bottom edges thereof; a movable jack plate fastened in said through-hole inside said molded receptacle, having an opening therethrough longitudinally aligned with said plug hole, and two rows of terminal slots respectively made on the top and bottom edges thereof;

two sets of terminals respectively formed in a substantially L-shaped structure, vertically disposed at two opposite locations and, respectively fastened in the two rows of terminal slots on said molded receptacle as well as on said movable jack plate, said two sets of terminals each terminating in a curved contact end; and wherein said two sets of terminals are respectively fastened in the rows of terminal slots on said molded receptacle and said movable jack plate with the contact end thereof disposed in position opposed to each other, permitting said movable jack plate to be moved downwards or upwards in said through-hole by means of the spring force from either set of terminals for connecting a plug which is inserted therein either in a normal or inverted position.

2. An adaptor socket structure as claimed in claim 1 wherein the movable jack plate has a front bevel edge engaging with a front retaining projection on the plug.

* * * * *